United States Patent [19]

Tapscott et al.

[11] Patent Number: 4,925,121

[45] Date of Patent: May 15, 1990

[54] SENSING AMOUNT OF MEDIUM AND MEDIUM ROLL MALFUNCTION IN A PRINTER

[75] Inventors: Peter A. Tapscott, Portola Valley; Thomas P. Courtney, Sunnyvale, both of Calif.

[73] Assignee: Xerox Corporation, Stamford, Conn.

[21] Appl. No.: 188,111

[22] Filed: Apr. 25, 1988

Related U.S. Application Data

[63] Continuation of Ser. No. 880,767, Jul. 1, 1986, abandoned.

[51] Int. Cl.[5] ..... B65H 17/12

[52] U.S. Cl. ..... 242/57

[58] Field of Search ..... 242/57, 75.51, 188, 242/189; 250/231 SE; 307/311

[56] References Cited

U.S. PATENT DOCUMENTS

| | | | |
|---|---|---|---|
| Re. 30,868 | 2/1982 | Mori | 340/675 |
| 3,281,634 | 10/1966 | Studer | 307/311 X |
| 3,898,436 | 8/1975 | Pottebaum et al. | 235/92 DN |
| 3,958,735 | 5/1976 | Wanat | 226/1 |
| 4,021,002 | 5/1977 | Meihofer | 242/58.1 |
| 4,040,043 | 8/1977 | Stanford | 340/259 |
| 4,089,482 | 5/1978 | Mooney et al. | 242/58.1 |
| 4,097,726 | 6/1978 | Satoh et al. | 235/92 MP |
| 4,151,403 | 4/1979 | Woolston | 235/92 DN |
| 4,159,572 | 7/1979 | Nunes | 33/142 |
| 4,204,180 | 5/1980 | Usui et al, | 335/205 |
| 4,213,575 | 7/1980 | Firth, III et al. | 242/57 |
| 4,239,404 | 12/1980 | Defilipps et al. | 400/613 |
| 4,291,843 | 9/1981 | Yanagawa | 242/57 |
| 4,337,903 | 7/1982 | Kessler et al. | 242/56 A |
| 4,456,193 | 6/1984 | Westover | 242/75.42 |
| 4,463,913 | 8/1985 | Sato | 242/57 |
| 4,473,009 | 9/1984 | Morgan | 101/232 |
| 4,491,430 | 1/1985 | Kuelzer | 400/208 |
| 4,525,654 | 6/1985 | Tajima | 242/75.51 X |
| 4,535,949 | 8/1985 | Olsson | 242/57 |
| 4,631,682 | 12/1986 | Ng et al. | 364/471 |
| 4,728,987 | 3/1988 | Diola et al. | 355/4 |

FOREIGN PATENT DOCUMENTS 0245187 11/1987 European Pat. Off. .

*Primary Examiner*—Katherine A. Matecki

*Attorney, Agent, or Firm*—James T. Beran

[57] ABSTRACT

An optical detector senses the teeth on a wheel rotating with an unwinding roll of medium in a printer and provides a signal which is used to count the sensed teeth to measure the rotation of the roll. When a predetermined proportion of a rotation is completed, the measured length of medium movement along a path through the printer during the predetermined proportion of a rotation is used to sense the condition of the medium. The conditions which may be sensed include amount of medium, medium thickness and medium malfunction. The circumference may, for example, be calculated and compared with a low medium circumference for the preselected or calculated thickness of the medium to detect a low medium condition. Periodically, the present medium position may be compared with its position when the last tooth was detected to sense a medium malfunction, either a medium out condition or a medium break. The teeth are triangular and shaped to provide a slowly varying signal from the optical detector which is converted to a purely digital signal by a high hysteresis Schmitt Trigger device. The processor which receives the digital signal also receives a signal indicating the length of medium movement.

8 Claims, 6 Drawing Sheets

SENSING AMOUNT OF MEDIUM AND MEDIUM ROLL MALFUNCTION IN A PRINTER

This is a continuation, of application Ser. No. 880,767, filed July 1, 1986, now U.S. Pat. No. 4,728,987.

BACKGROUND OF THE INVENTION

The present invention relates to techniques for sensing conditions of a medium, such as paper or film, in a device performing operations on the medium. More specifically, the invention relates to techniques in which the amount of medium and malfunctions of a roll of medium are sensed based on the rotation of the medium roll.

In printing or plotting on a medium such as paper or film, failure to stop before the supply of medium is exhausted can damage the writing elements, necessitating expensive repairs. Therefore, means are conventionally provided in a printer to sense a no medium condition and protect the writing elements. Also, sensing a low medium condition makes it possible to delay a long plot or listing until an adequate medium supply is available.

One conventional technique for sensing low and no medium conditions depends on optically sensible marks placed on the non-printed side of the medium during manufacture. The sensing of a mark near the end of a medium roll indicates a no medium condition and the sensing of another, distinguishable mark some distance from the end indicates a low medium condition. This technique becomes unreliable, however, if the marks are incorrectly positioned, if the medium is damaged or torn, or if the medium is transparent or nearly transparent with black writing on its printed side which can be confused with a mark. Therefore, complicated backup media-out sensors are necessary. Also, powering off the printer after detection of the low medium mark will eliminate the low medium warning, the next warning occurring when the medium is exhausted.

Another conventional technique for sensing a low medium condition depends on a sensor which directly detects the radius of a roll of medium. U.S. Pat. No. 4,204,180, for example, discusses a device which mechanically detects the end of a paper roll in a printer, providing a signal indicating that a predetermined amount of paper remains. U.S. Pat. No. 4,239,404 discusses a system including an infrared transmitter and receiver arranged at opposite ends of a paper roll in a printer to detect a radius reflecting a low paper condition. The system also includes a mechanically deflected arm which detects a paper out condition and provides a signal. This is necessary because the radius of the medium core varies due to manufacturing tolerances, so that radius sensing can only detect low medium, not a no medium condition. In general, radius sensing depends on expensive mechanisms or circuitry requiring critical tolerances and adjustments.

A number of techniques are used in other fields for sensing or detecting the amount of an unwinding web-like material on a roll, to avoid reaching the roll end. U.S. Pat. No. 4,040,043 discusses apparatus for mechanically detecting the remaining quantity of film on a reel in a packaging apparatus. U.S. Pat. No. 4,491,430 and 4,213,575 discuss devices which mechanically monitor the amount of ribbon on a printer ribbon reel. U.S. Pat. No. 4,097,726 discusses a device which detects an approaching tape ending in a tape recorder by comparing the rate at which the tape roll rotates with a reference rate.

Some techniques for automatically splicing or exchanging rolls of web material rely on reaching a predetermined web length or roll radius before splicing or exchanging. U.S. Reissue Patent Re. 30,868 relates to a paper splicing apparatus in which a predetermined roll diameter is sensed by comparing two pulse trains, one resulting from the paper roll rotation and the other from a guide roll rotation; when the rates coincide, the diameter has been reached. U.S. Pat. No. 4,089,482 similarly measures the length of web unwound per revolution of a web roll and compares it to a predetermined length as part of determining when to splice. U.S. Pat. Nos. 4,337,903 and 4,151,403 also take into account both web length counting pulses and roll revolution counting pulses in controlling a roll exchange or splice. U.S. Pat. No. 4,021,002 relates to a different auto-splice technique using photosensors to detect radius while also measuring length.

Other techniques make use of web length and roll rotation measurements in controlling the winding or unwinding of a web-like material during a manufacturing process. U.S. Pat. No. 4,535,949 discusses a device for measuring rolled-up length of a web roll which, upon sensing a web break, calculates roll circumference based on web length measurement and web roll rotation counting. U.S. Pat. No. 4,463,913 describes prior art apparatus which measures circumferential length of a coil turn based on rotational rates of the coil and of a motor driving a bridle through which the coiled material passes. U.S. Pat. Nos. 4,159,572 and 3,898,436 discuss similar techniques relating rates of rotation.

It would be advantageous to provide a simple and inexpensive medium condition sensing technique for use in a printer or plotter which would not depend on marks on the medium or on the direct detection of roll radius. It would further be advantageous to provide a sensing technique which would operate properly despite the printing operation itself and despite malfunctions such as running out of medium or a medium break.

SUMMARY OF THE INVENTION

The present invention provides techniques for medium condition sensing which are simple, inexpensive, and suitable for use in a printer or plotter. The sensed medium conditions may include medium amount, low medium, or medium roll malfunction, such as no medium or medium broken. The techniques of the invention use sensing and control circuitry which may already be present in a conventional printer or plotter. As used herein, the term "printer" includes plotters and similar printing devices.

As noted above, a no medium condition in a printer can damage the writing elements. A medium break can have the same effect. The present invention provides a simple sensing technique which can detect a no medium condition and may also detect a medium break. This aspect of the invention is based on the recognition that the exhaustion of the medium results in a medium roll stopped condition, and a medium break may do the same.

In a printer, the rate of medium movement may not be constant. The medium may reverse direction several times during the printing of a multi-colored image, with rewinding being necessary to permit the printing of another color. The invention provides a simple sensing technique for medium conditions which is not affected by rewinding, by changes in the rate of medium movement or by powering off the printer. This aspect of the invention is based on the recognition that current medium conditions may be sensed during a relatively small rotation of the medium roll without regard to the past history of medium movement.

Vibrations may occur in a printer, causing the medium roll to rock back and forth slightly at times when it is not rotating. This rocking will interfere with the sensing of medium roll rotation, because false rotation signals will occur when a rotation sensor is actuated by the rocking. A sensing technique according to the invention, however, uses a rotation detector which is not sensitive to vibration of the medium roll.

A number of different media may be used in a printer, each having a discrete thickness. Therefore, if the low medium condition corresponds to a specific amount of remaining medium, the radius of the medium roll at the low medium condition will differ for each medium. The technique of the invention permits accurate sensing of the low medium condition for more than one medium thickness, based on determining the size of the roll in the low medium condition for each thickness. The technique of the invention further permits sensing the thickness of the medium, because medium thickness may be inferred from information about medium roll rotation and length of medium movement.

A method of sensing medium condition on a roll according to the invention includes detecting whether the roll has rotated a predetermined proportion of a rotation; measuring the length of medium movement along its path during the roll's rotation; and using the measured length to determine the medium condition. The proportion of a rotation may be detected from elements rotating with the roll, such as teeth on a wheel. When the number of teeth which have passed the detecting position reaches the predetermined proportion to the number of teeth on the wheel, the roll has reached the predetermined proportion of a rotation.

The amount of medium on the roll may be sensed by obtaining a value reflecting the amount of medium, such as the circumference of the roll or the length of medium remaining on the roll, from the measured length. This value may be compared with a low medium value to determine whether the roll is in a low medium condition. When a low medium condition is detected a predetermined successive number of times, the operator is signaled.

The thickness of the medium on the roll may also be sensed based on the measured length, or the operator may input information indicating medium thickness. The medium may have one of a number of thicknesses, with the measured or operator inputted thickness being used to obtain the low medium value for sensing the low medium condition.

A medium roll malfunction may be sensed by detecting whether one of the teeth has reached the detecting position and, if so, updating a stored position of the medium. Periodically the present position of the medium is compared with the stored position to determine whether the medium has moved. If the medium has moved by a minimum offset while no teeth have been detected, a medium roll malfunction has occurred, and the medium is stopped to avoid damage.

Apparatus for monitoring medium condition according to the invention includes means for detecting whether the roll has rotated the predetermined proportion; means responsive to the detecting means for updating a measured length of medium movement; and means for determining the medium condition based on the measured length. The detecting means includes a toothed wheel and an optical detector for sensing a tooth at the detecting position. The signal from the optical detector is conditioned by circuitry which includes a Schmitt Trigger to provide a digital input to a processor. The optical detector has a linear region and the teeth are triangular so that the optical detector signal slowly passes linearly from on to off as a tooth enters the detecting position. The Schmitt Trigger has a large hysteresis range so that the digital signal is accurate despite vibration of the wheel. The processor receives the digital signal periodically and updates the measured length if the digital signal indicates a tooth has entered the detecting position. The processor also determines the medium condition.

These and other objects, features and advantages of the invention will be more fully apparent from the attached drawings and the following detailed description and claims.

DETAILED DESCRIPTION OF THE PREFERRED EMBODIMENTS

Figure 1:
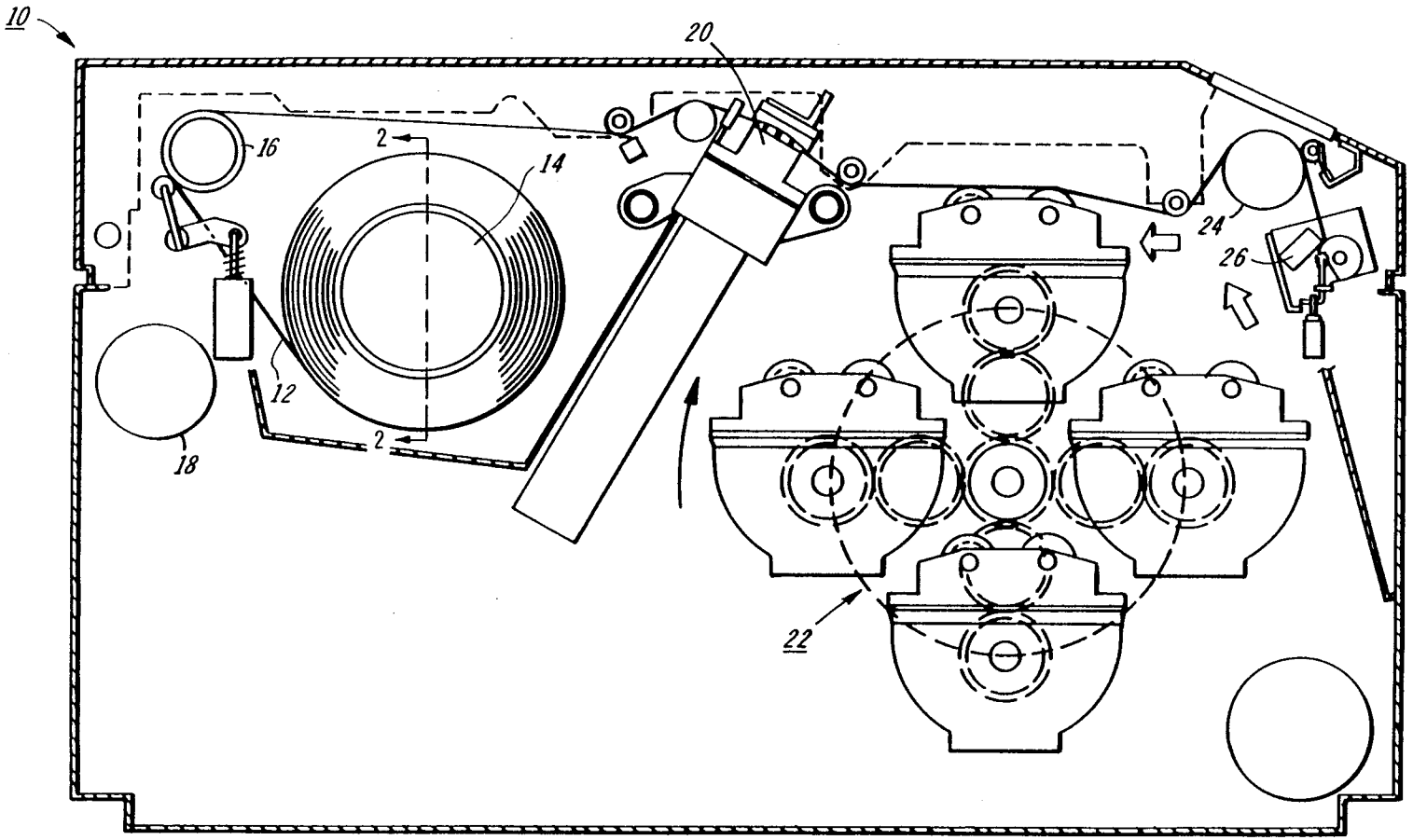
FIG. 1 is a schematic drawing of a plotter in which the present invention may be used.

FIG. 1 shows electrostatic plotter 10, an example of a printer incorporating the invention. A supply of medium 12 is provided on roll 14. From roll 14, medium 12, which may for example be paper or film, follows a path around drive roller 16 driven by driver 18, after which it receives a surface electrostatic charge from writing element 20. Coassigned application Ser. No. 880,756 now U.S. Pat. No. 4,728,987, incorporated herein by reference, describes in relation to FIG. 11B the coupling through which drive roller 16 is driven, including belts and a reduction pulley. Driver 18 is equipped with an encoder such as a conventional quadrature detector on its shaft for signalling the amount by which it rotates. As long as medium 12 is moving properly along its path, the rotation of driver 18 corresponds to the length of movement of medium 12 along the path, so that the encoder serves as means for measuring the length of movement of medium 12 as well as for measuring the rotation of driver 18. This encoder is further shown herein as length encoder 64 in FIG. 4, and is also shown and described in relation to FIG. 11B of coassigned application Ser. No. 880,756 now U.S. Pat. No. 4,728,987.

The arrangement 22 of toner fountains shown in FIG. 1 is described in detail in coassigned application Ser.

No. 880,756 now U.S. Pat. No. 4,728,987, incorporated herein by reference. Each of the fountains may have a different toner color, so that toner is applied successively from each fountain by advancing medium 12 past one fountain in arrangement 22 and then rewinding it onto roll 14 before applying toner from another fountain. Medium 12 is held at the appropriate tension as it advances by tension roller 24, and when an image is completed, cutter 26 is actuated to cut off the plotted image.

Figure 2:
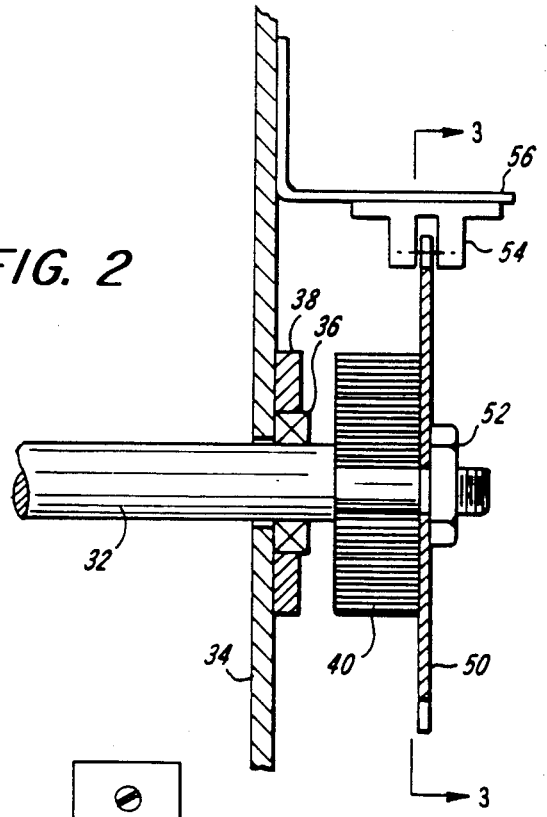
FIG. 2 is a cross-sectional view taken along the line 2—2 in FIG. 1, showing a toothed wheel and optical detector.

FIG. 2 shows components of printer 10 which provide signals reflecting the rotation of roll 14 as medium 12 is unwound and advances along its path. Shaft 32 supports the cardboard core of roll 14. Shaft 32 extends through a side panel 34 of printer 10 and is in turn supported on bearing 36 held in place by retainer 38. Pulley 40 is driven to maintain tension on roll 14 during rewinding.

In addition to the roll 14 and pulley 40, shaft 32 supports toothed wheel 50, held in place by nut 52 or a clip or other suitable retainer. Optical detector 54 is mounted on bracket 56 on side panel 34 so that the optical beam extends across the toothed part of wheel 50. Each tooth interrupts the optical beam as it enters the detecting position. Optical detector 54 may be an inexpensive OPB875 slotted optical switch.

Figure 3:
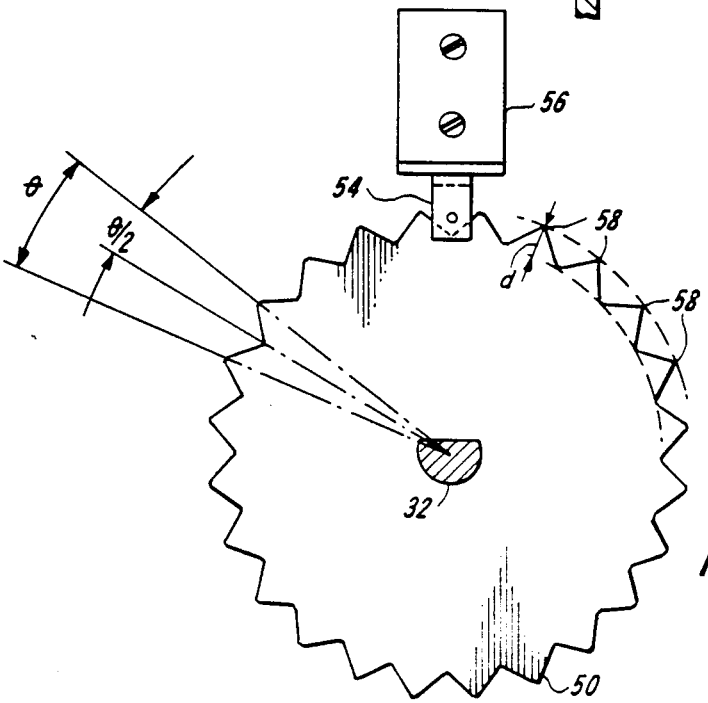
FIG. 3 is a partial cross section along line 3—3 in FIG. 2.

Wheel 50 is shown from the side in FIG. 3, with optical detector 54 and bracket 56. Wheel 50 may be stamped from sheet metal. Teeth 58 are triangular and of the same height and shape. Wheel 50 has 24 teeth, the point to point angle $\theta$ being 15°. The selection of the number of teeth depends on a number of factors discussed in greater detail below. As can be seen from FIG. 3, the depth d of teeth 58 depends on the number of teeth and the slope of the sides of each triangular tooth, the slope being selected for reasons discussed below.

Figure 4:
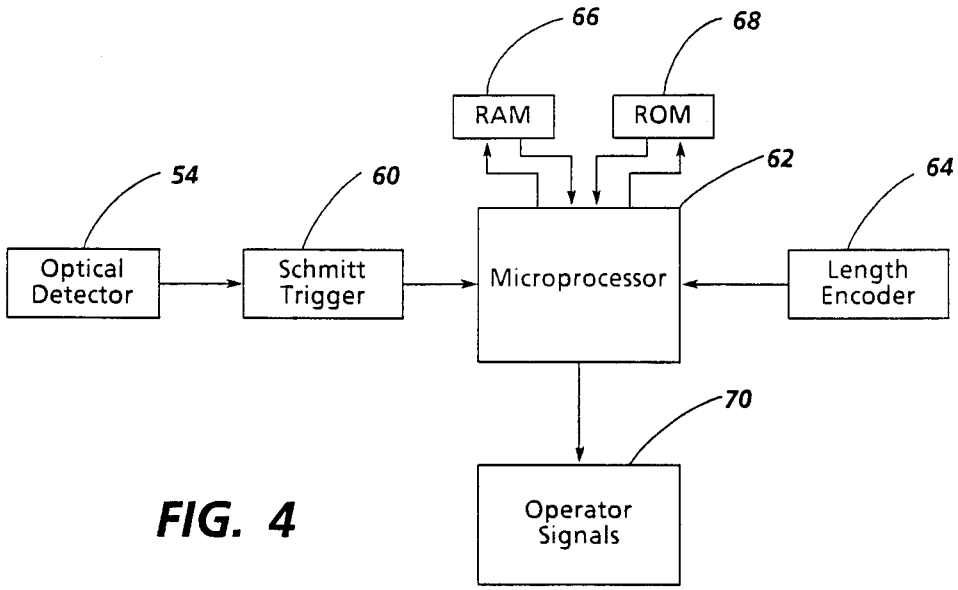
FIG. 4 is a schematic diagram of the circuitry which receives signals from the optical detector of FIG. 2.

FIG. 4 shows the circuitry which receives and processes the signals from optical detector 54. Schmitt Trigger device 60 receives the signals and converts them to a purely digital signal which is received by microprocessor 62, which may be a conventional microprocessor such as an Intel 8086. Length encoder 64 also provides digital signals to microprocessor 62 indicating the length of medium 12 which has moved along the path through printer 10. Length encoder 64 could be any conventional encoder, including the types disclosed in U.S. Pat. No. 4,473,009, but is preferably a shaft encoder or other rotary encoder based on the operation of drive roller 16 or driver 18, an example of which was discussed above in relation to FIG. 1.

Microprocessor 62 will execute a program stored in conventional ROM 66, using RAM 68 for temporary storage of data. When a low medium or roll stopped condition is detected, an appropriate signal will be provided to the operator through operator signals 70.

Figure 5:
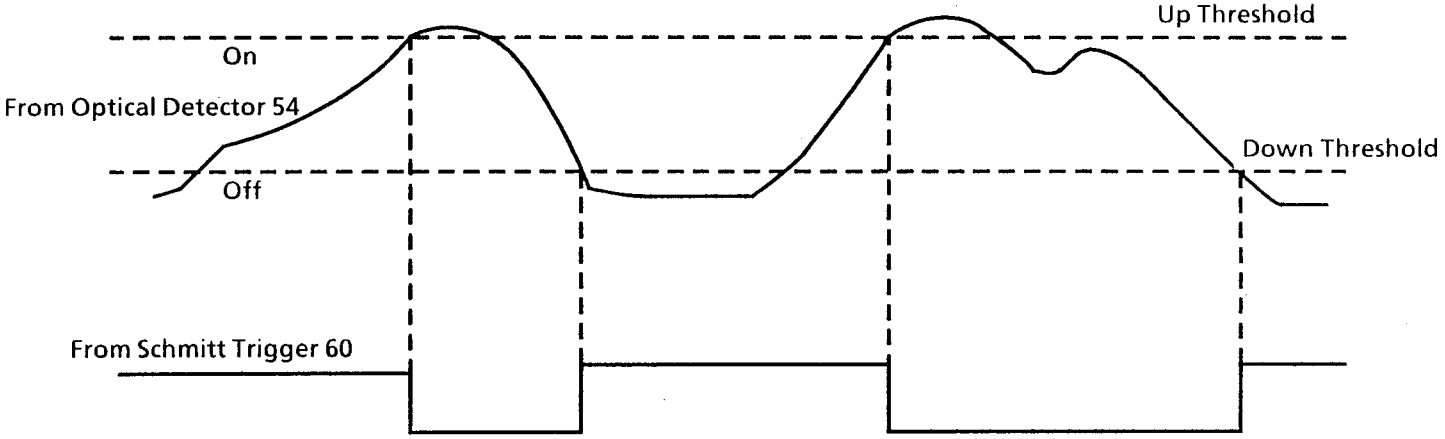
FIG. 5 is a timing diagram illustrating the operation of the Schmitt Trigger device of FIG. 4.

FIG. 5 shows how Schmitt Trigger 60 generates a digital signal from the output of optical detector 54. As shown in the upper part of FIG. 5, the signal from optical detector 54 is smooth, a result of teeth 58 being triangular rather than the conventional square shape. Optical detector 54 makes a transition across its linear region from on to off as a tooth enters the detecting position, slowly breaking the optical beam. Then, when the tooth moves on, the beam slowly reappears, and a transition is made across the linear region from off to on. The slope of the sides of each triangular tooth determines the rate of the transition.

Vibrations in printer 10, however, add irregularities to the signal from optical detector 54. Conventionally two detectors are used to prevent false readings which occur when the toothed wheel stops with a tooth just entering the detecting position. Ordinary machine vibrations would cause the tooth to move into and out of the detecting position, generating a signal indicating a series of teeth and leading to erroneous results. Although two detectors would solve this problem, detector cost would be doubled; the relative positions of the detectors would be critical, perhaps requiring manual adjustment; and additional circuitry or very fast software would be required to decode the data from the two detectors.

The solution of the present invention is to use a single optical detector 54 with an inexpensive Schmitt Trigger device having a large hysteresis range. The horizontal dashed lines in FIG. 5 show the up threshold and down threshold of such a device. An inexpensive TTL compatible device such as a 74CH14 Schmitt Trigger Inverter would be suitable, and the lower part of FIG. 5 shows how such a device provides a purely digital output in response to the quasi-analog output of optical detector 54. In order to obtain this output despite vibrations, it is necessary, as noted above, that the teeth on wheel 50 have appropriately sloped sides. In FIG. 3, teeth 58 have an angle of slightly less than 90° at each outward vertex, but if a more gradual slope is necessary to obtain a purely digital output from Schmitt Trigger 60, the depth d of the teeth may be appropriately decreased to permit a greater angle at each outward vertex and a more gradual slope.

Figure 6:
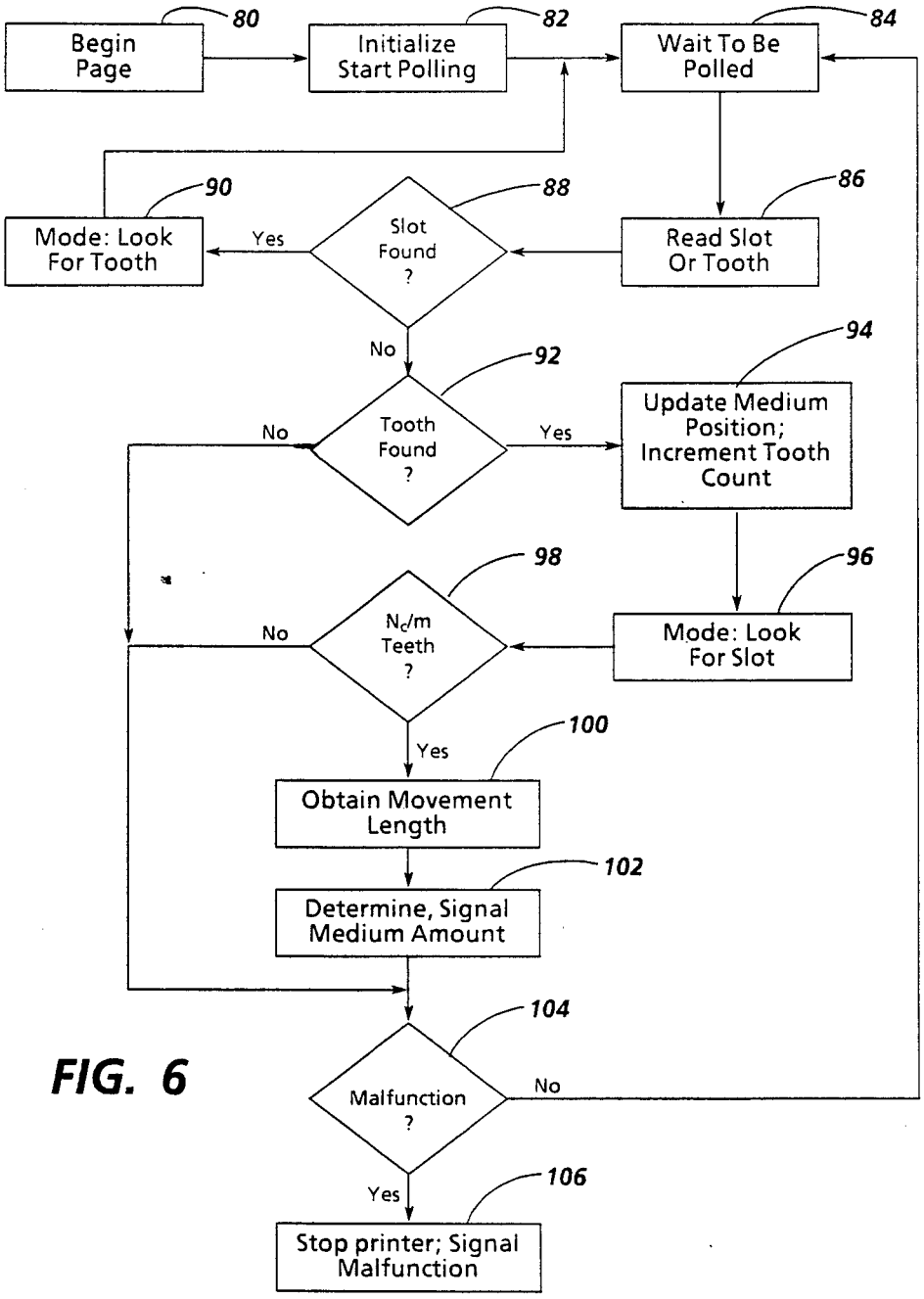
FIG. 6 is a flow chart of operations of the microprocessor of FIG. 4 which sense medium conditions such as medium amount and medium malfunction.

FIG. 6 is a flow chart showing steps by which microprocessor 62 may detect medium conditions including the medium amount and medium malfunctions. Conventionally, microprocessor 62 will also be controlling a number of other operations of printer 10, as disclosed for example in coassigned application Ser. No. 880,756, now U.S. Pat. No. 4,728,987. Microprocessor 62 executes the steps in FIG. 6 after it begins plotting a page, as shown in box 80, but similar steps could be followed during any medium movements in order to sense medium conditions. In box 82 a number of variables will be initialized and the operating system of microprocessor 62 will be requested to poll and execute the remainder of the routine in FIG. 6 at some appropriate time interval, such as 40 msec. Other alternative techniques could be employed, such as a dedicated microprocessor continuously sensing or an interrupt driven microprocessor which is interrupted whenever the digital signal from Schmitt Trigger 60 has a leading edge, for example.

In box 84, the routine of FIG. 6 waits to be polled. Meanwhile, other routines are starting to operate printer 10, causing drive roller 16 to unwind medium 12 from roll 14, and causing toothed wheel 50 to rotate with roll 14. A conventional routine determines the position of medium 12 along the path to a resolution of a hundredth of an inch based on the signal from length encoder 64. This could be done, for example, by counting pulses.

When the routine of FIG. 6 is polled, it reads the output of Schmitt Trigger 60 to obtain a value indicating either a tooth or a slot between teeth on toothed wheel 50, in box 86. During initialization, a mode value will be set to indicate that a tooth or a slot is at the detecting position, and the routine of FIG. 6 will look for a change at the detecting position. The test in box 88 determines whether a slot is being looked for and a slot is at the detecting position; if both are true, the stored mode value is changed to look for a tooth in box 90. Similarly, the test in box 92 determines whether a tooth is being looked for and a tooth is at the detecting position. The tests in boxes 88 and 92 thus detect the leading edge of a tooth as it enters the detecting position.

When a leading edge is detected in box 92, the steps in boxes 94–98 determine whether roll 14 has rotated through a predetermined proportion of one rotation. If so, the step in box 100 obtains the length medium 12 has moved during that proportion of a rotation and the step in box 102 determines the medium amount based on that length and provides a signal to the operator indicating medium amount.

In box 94, a stored current position of medium 12 is updated to reflect the position of medium 12 when a tooth was found. Also, a stored tooth count is incremented by one to reflect the number of teeth detected. The stored mode value is changed in box 96 to look for a slot at the detecting position. Then the test in box 98 compares the stored count of teeth with the number of teeth in the predetermined proportion of one rotation, $N_c/m$. $N_c$ is the number of teeth around the circumference of toothed wheel 50 and m is the number of times per rotation that the low medium condition is being tested.

When $N_c/m$ teeth have been counted, the step in box 100 obtains a value reflecting the length by which medium 12 has moved during the rotation of roll 14 yielding that count. This value could be the actual length itself, calculated by subtracting a previous medium position from the updated position from box 94. This value can then be used in box 102 to determine the medium amount and provide an appropriate signal to the operator. An example of how this may be done is discussed below in relation to FIG. 7.

FIG. 6 also shows the steps in boxes 104–106 for sensing a medium malfunction. The most common malfunction by far is a medium out condition occurring as the result of exhausting the supply of medium on roll 14. Other malfunctions may also be detected, including certain medium breaks, because information is available about the rotation of roll 14 and about the rotation of driver 18. Any medium malfunction which causes roll 14 to stop rotating even though driver 18 continues to rotate may therefore be sensed, including medium out and medium broken. The test in box 104 determines whether a medium malfunction has occurred, and, if so, the printer is stopped and a malfunction signal is provided to the operator in box 106. An example of a malfunction detection test is discussed below in relation to FIG. 7.

The steps in FIG. 6 illustrate general features of methods of detecting medium condition, such as medium amount or medium malfunction, according to the invention. The steps in FIG. 7 illustrate specific features of a method for sensing a low medium condition or a medium malfunction.

Figure 7:
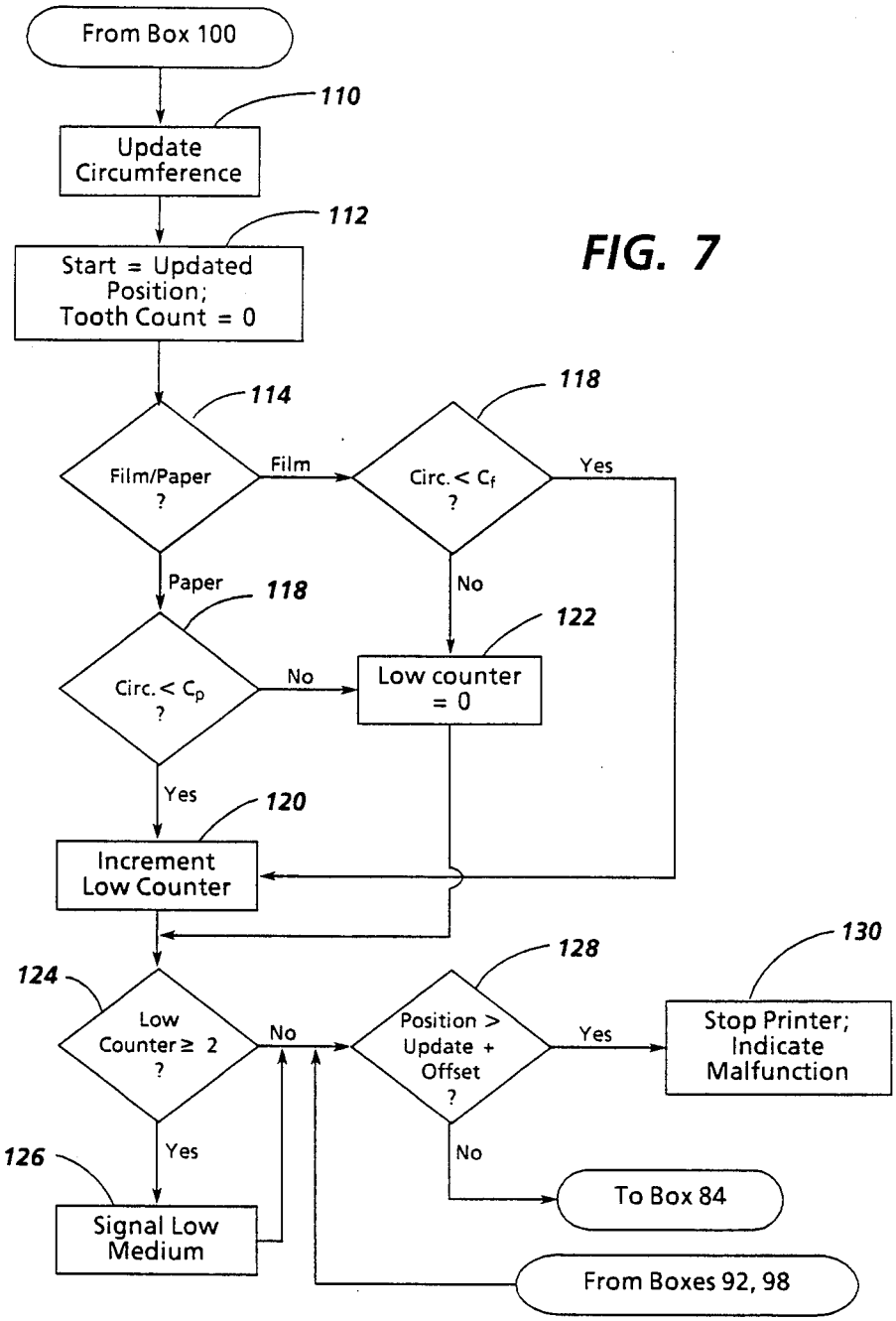
FIG. 7 is a flow chart of operations of the microprocessor of FIG. 4 which specifically sense low medium and medium out conditions.

FIG. 7 shows a series of steps which may follow the step in box 100 in FIG. 6, and which determine the medium amount, signal the operator, and sense for medium malfunction. Initially, the circumferene of the rolls is updated in box 110 based on the length of medium advance while roll 14 turned through the predetermined proportion of a rotation. The length of medium advance can be calculated as the difference between the updated position from box 94 and a stored starting position. The circumference can then be calculated by multiplying m times the length of medium advance, which is mathematically equivalent to dividing the length of medium advance by the predetermined proportion. After these calculations, the stored starting position is advanced to the updated position from box 94, in box 112, and the count of teeth begins again at zero.

In performing the step in box 110, microprocessor 62 normally measures the length of movement by medium 12 along its path during the rotation of roll 14 through the predetermined proportion of a rotation. If medium 12 is exhausted or broken, however, and if the measurement of length is based on rotation of driver 18, the step in box 110 would merely measure the distance which driver 18 has attempted to advance medium 12 along its path—medium 12 may not actually advance by that distance. Ordinarily, however, the test in box 92 in FIG. 6 will not find any teeth when such a medium malfunction occurs, because medium roll 14 will cease rotating, so that microprocessor 62 will not reach the step in box 110.

The next part of the routine of FIG. 7 determines whether a low medium condition exists on roll 14, in boxes 114–118. This may be done by comparing the updated circumference from box 110 with a circumference at which the medium is low. Since the medium may have more than one thickness, however, the low medium circumference will depend on medium thickness. The test in box 114 determines medium thickness, which is assumed to have one of two values—a thickness for paper or a thickness for film. The routine of FIG. 7 could be readily modified to test for more than two values of medium thickness.

The test in box 114 may be done by testing a stored value based on an operator input selecting paper or film as the medium. As noted above, this selection could be between more than two thicknesses. If the operator selected paper, the test in box 116 compares the updated circumference from box 110 with a stored low medium circumference for paper, $C_p$. Similarly, the test in box 118 compares with a stored low medium circumference for film, $C_f$. This comparison could be with another low medium value based on the low medium circumference, such as the length of advancement of medium 12 which would yield the low medium circumference when multiplied by m.

The test of box 114 could also be implemented by calculating the thickness of the medium from the information provided by the detectors, provided that the detectors provide sufficiently accurate information to distinguish between the media which could be used. The change in cross-sectional area of roll 14 as medium 12 unwinds is equal to the length by which medium 12 moves multiplied by the medium thickness $t_m$. As noted above, the circumference of roll 14 can also be calculated from the length medium 12 moves during a part of one rotation. From the equations for the circumference and area of a circle, $C=2\pi r$ and $A=\pi r^2$, we obtain $$t_m(\Sigma L)=A_1-A_2=(C_1^2-C_2^2)\div 4\pi,$$

$$\text{so that } t_m=[m2/4\pi(\Sigma L)](L_1^2-L_2^2),$$

where $L_1$ and $L_2$ are the lengths measured through a first part and a last part of rotation of roll 14; $\Sigma L$ is the total length of movement of medium 12 from the beginning of $L_1$ to the end of $L_2$; $A_1$ and $A_2$ are the cross-sectional areas corresponding respectively to $L_1$ and $L_2$;

and m is the number of times per rotation of roll 14 that length of movement is determined, as discussed above in relation to FIG. 6. Therefore, the thickness $t_m$ can be determined directly from measurements of the length of movement of medium 12. Furthermore, the calculated thickness $t_m$ of medium 12 could be continuously updated, and changes in the updated value could be used to correct for manufacturing differences in medium rolls or to sense an abnormal medium thickness.

Similarly, the low medium circumference of roll 14 for the specific thickness of medium 12 could be calculated based on a desired length $L_d$ of medium remaining on roll 14 when the low medium condition is signaled. This calculation is based on the same starting equation as above, except that $A_2$ and $C_2$ are replaced by $A_c$ and $C_c$, the area and circumference of the core of roll 14, which must be predetermined with an appropriate degree of accuracy and stored or otherwise made available for calculation. Solving for $L_d$:

$$L_d=\Sigma L=(C_d^2-C_c^2)\div 4\pi t_m,$$

where $C_d$ is the as yet unknown low medium circumference and m is the inverse of the predetermined proportion as above. This leads to a solution for $C_d$:

$$C_d=(4\pi t_m L_d+C_c^2)^{\frac{1}{2}},$$

Therefore, once $t_m$ is known, whether from user input or from measurements of length as above, the low medium circumference $C_d$ can be determined directly from a specified remaining length $L_d$ of medium 12.

If the low medium condition is detected, whether from a predetermined low medium circumference as in boxes 116 and 118 or from a calculated low medium circumference, an indication is provided to increment a low counter in box 120. If the updated circumference from box 110 does not indicate a low medium condition, however, the low counter is set to zero in box 122. Then, in box 124, the low counter is tested to see if it has reached a value of two. In other words, the low medium condition must be detected more than once in succession to be treated as conclusive. This may be necessary because the initial measurement of circumference after initialization may be based on an inaccurate measurement, since the initial setting of the mode is based not on an edge but on whatever value is received from Schmitt Trigger 60. The number of successive detections of the low counter condition could be greater than two if greater certainty is required. When the number of successive detections is found in box 124, a low medium signal is provided to the operator in box 126, using a control panel low medium light or similar warning mechanism in operator signals 70.

In addition to sensing the low medium condition, the remaining length $L_r$ of medium 12 on roll 14 could be sensed at any time based on the above equation for $L_d$:

$$L_r=(m^2L^2-C_c^2)\div 4\pi t_m,$$

where L is the length of medium movement and m is the inverse of the predetermined proportion as above. As with the other calculations set forth above, this calculation could be replaced by one or more look up tables if the values of $t_m$ and $C_c$ were constant or each had one of a few predetermined values. If the remaining length $L_r$ were sensed, an LED bar graph display or a digital readout in operator signals 70 could be used to signal the remaining length to the operator.

Another approach to sensing medium amount based on measurements of length of movement of medium 12 is based on the increase in circumference resulting from each wrap of the medium around its core. The increase in diameter of roll 14 should be $\Delta=2t_m$ for each wrap. If there are n wraps, the increase in circumference should be equal to $n\pi\Delta$. The present circumference $C_p$ will then be $C_c+n\pi\Delta$, and we can solve for n:

$$n=(C_p-C_c)/\pi\Delta.$$

The remaining length $L_r$ can then be calculated as a sum of circumferences:

$$L_r=C_c+(C_c+\pi\Delta)+\cdots=n(C_c+(n+1)\pi\Delta/2)=((C_p^2-C_c^2)/2\pi\Delta)+(C_p-C_c)/2,$$

so that the length of medium remaining can be calculated based on the medium thickness and the present circumference at any time. Note that this yields substantially the same result as the above equation for $L_d$, except for the last term, which is likely to be negligible for a small number of turns of a thin medium.

The above equation also suggests that the medium thickness may be obtained based on a count of the number of rotations of the medium roll together with a determination of the difference in circumference resulting from those rotations:

$$t_m=(C_1-C_2)/2\pi n,$$

providing an alternative to the calculation given above.

In order for the routine of FIG. 7 or a similar routine to precisely detect medium amount, the circumference of the roll must decrease at least as much as the smallest resolution of measured medium movement. As noted above, medium movement can typically be measured to a resolution of about one hundredth of an inch. Since paper is about three mils thick, and film is about four mils thick, and since the decrease in the circumference is the product of $\pi$ times the decrease in diameter, the decrease in circumference per rotation for paper and film is about 1.9 and 2.7 hundredths of an inch, respectively, since two layers of the medium are removed from the diameter by each rotation. Therefore, roll circumference decreases sufficiently to allow precise detection. Other factors in precision are the frequency and accuracy of polling, the number of teeth on the toothed wheel, and the rate of medium movement along the path. An error of ±10% is considered acceptable, but the technique of the invention can be applied to obtain an error of about ±2%, typically.

Printer 10 may, for example, have a maximum forward medium speed of 2 to 2.5 inches per second, while roll 14, when nearly empty, has a typical circumference greater than nine inches. Therefore, the minimum time for one full rotation is at least 3.6 seconds. With a polling interval of about 40 msec, microprocessor 62 will read the output from Schmitt Trigger 60 about 90 times per rotation, so that not all teeth and slots will be detected unless there are 45 teeth or less on toothed wheel 50. To provide a 50% safety factor, about 23 teeth would be necessary. A wheel with 24 teeth facilitates calculation of circumference, which is the most straight forward and understandable measure of the low medium condition. Also, microprocessor 62 typically multiplies and divides more slowly than other operations, so that it is most convenient to have a number of teeth with many factors to permit calculation of circumference with a single multiplication. The minimum length of medium movement in printer 10 to print one image will typically be less than the circumference of roll 14 when full, so that circumference must be calculated from less than a full rotation of roll 14. If wheel 14 has 24 teeth, twelve, eight or six teeth may be counted before multiplying medium movement by two, three or four, respectively, to obtain circumference with minimal calculation. Counting twelve teeth is preferred because it reduces the error resulting from variations in the polling rate, leading to consistent circumference measurements.

The final feature of the routine of FIG. 7 is to detect a medium malfunction. The specific technique shown senses a stopped condition of roll 14, indicating a medium out condition, a medium break or some other malfunction. A roll stopped condition is easy to detect, because it will occur whenever driver 18 rotates a predetermined even though no teeth have entered the detecting position, meaning that roll 14 has not rotated. Medium 12 may not actually be moved, because it will be exhausted or broken, causing the stopped roll condition. The minimum rotation of medium roll 14 will normally occur when it is full; if a break occurs in medium 12 at that time, roll 14 may stop even though full. The minimum rotation of driver 18 above which failure to detect a tooth indicates a roll stopped condition corresponds to the circumference of medium roll 14 when full divided by the number of teeth on wheel 50. If medium roll 14 when full has an 18 inch circumference and wheel 50 has 24 teeth, this minimum distance is 0.75 inches. To reduce false detections, it is preferable to allow medium 12 to move more than this before concluding that a roll stopped condition exists. In printer 10, on the other hand, if medium 12 moves more than about three inches, writing element 20 may be damaged. Therefore a stop distance of 1.5 inches, the geometric mean of 0.75 and 3.0 inches, is appropriate. In other words, if no teeth are detected while driver 18 rotates by the amount necessary for drive roller 16 to advance medium 12 by 1.5 inches along the path, printer 10 should be stopped.

The test in box 128 performs this technique by comparing the present medium position with the sum of the updated position from the last time a tooth was detected, as stored in box 94, plus the stop distance. If the present position is greater, a roll stopped condition has been detected, and printer 10 is stopped in box 130. A control panel light signaling medium malfunction may also be flashed, and a signal may be provided to a host computer providing the data to be printed.

The techniques of the invention sense medium conditions simply, inexpensively and reliably compared to other techniques. The medium need not be specially manufactured. A wide variety of medium conditions, including medium amount, medium thickness and medium malfunction, can be sensed. A low medium condition can be detected using the routine of FIG. 7 whenever medium 12 moves by at least one full rotation, regardless of whether printer 10 has been powered off and restarted in the low medium condition. Thus an operator will receive a low medium signal before a signal indicating the medium out condition despite powering off printer 10. Also, a medium malfunction causing a roll stopped condition will be detected regardless of its cause. No alignment is required, so that both installation and parts are inexpensive.

Many variations will be apparent to one of ordinary skill in the art. Any suitable technique for measuring the predetermined proportion of a rotation can be used, with toothed wheel 50 and optical detector 54 replaced by other suitable rotation sensing components. Schmitt Trigger 60 could be replaced by another suitable analog-to-digital converter.

Many other variations will also be apparent from the above description and the attached drawings. The scope of the invention is not limited by the specific embodiments disclosed above, but only by the attached claims.

What is claimed is:

1. A method comprising the steps of:

rotating a drive means for unwinding a medium from a roll and for moving the medium along a path;

measuring drive means rotation;

during rotation of the drive means, detecting whether one of a series of elements that rotate when the roll rotates has reached a detecting position;

when one of the elements has reached the detecting position, updating a stored position value using the measured drive means rotation, the stored position value indicating the length of medium movement at the time the element reached the detecting position;

periodically obtaining a present position value using the measured drive means rotation, the present position value indicating the length of medium movement to a present time in the absence of a stopped roll condition; and comparing the present position value with the stored position value to determine whether the roll has rotated while the drive means had rotated, failure of the roll to rotate indicating that the stopped roll condition has occurred.

2. The method of claim 1 in which the method is performed in a printer that has writing elements along the path, the step of comparing the present position value with the stored position value comprising determining whether the present position value exceeds the sum of the stored position value and an offset, the offset being larger than the distance the medium would move along the path between the time when one element reaches the detecting position and the time when the next element would reach the detecting position if the roll is full and smaller than the distance the medium can move from the roll before reaching the writing elements of the printer.

3. The method of claim 1, further comprising stopping the drive means and providing a stop signal to an operator when the comparing step determines that the stopped roll condition has occurred.

4. The method of claim 1, in which the step of comparing the present position value with the stored position value comprises determining whether the present position value exceeds the sum of the stored position value plus an offset, the offset being larger than the distance the medium will move along the path between the time when one element reaches the detecting position and the time when the next element reaches the detecting position if the roll is full and smaller than the distance the medium can move from the roll before reaching a critical point along the path.

5. Apparatus for determining medium condition in a printer, the printer including a roll of a medium and means for unwinding the medium from the roll and moving the medium along a path through the printer, the apparatus comprising:

means for detecting whether a roll of a medium has rotated a predetermined proportion of one rotation;

means for measuring a length that the medium moves along the path while the roll rotates through the predetermined proportion;

means responsive to the detecting means for obtaining the measured length from the measuring means when the detecting means detect that the roll has rotated through the predetermined proportion; and means for determining a medium condition based on the measured length, wherein the medium condition is one of amount of medium on the roll, medium thickness, low medium condition, or medium malfunction;

the detecting means comprising means for generating signals linearly, the signal generating means comprising a toothed wheel mounted to rotate with the medium roll and an optical detector positioned for generating an optical detector signal indicating whether a tooth is at the detecting position, the optical detector having a region in which it generates the optical detector signal linearly, each tooth on the wheel being shaped to cause the optical detector signal to slowly pass linearly from on to off as that tooth enters the detecting position so that the optical detector signal is generated linearly.

6. The apparatus of claim 5 in which the detecting means further comprises signal conditioning circuitry for receiving the signal from the optical detector and for providing a digital signal, the detecting means further comprising a processor operable in response to the conditioned signal for counting the teeth sensed at the detecting position and for determining that a number of teeth counted indicates the predetermined proportion of one rotation.

7. The apparatus of claim 6 in which the signal conditioning circuitry comprises a Schmitt Trigger device having a large hysteresis range for providing an accurate digital signal in response to the optical detector signal.

8. The apparatus of claim 5 in which each too this triangular.

* * * * *